US006146477A

United States Patent [19]

Clark et al.

[11] Patent Number: 6,146,477

[45] Date of Patent: Nov. 14, 2000

[54] METAL ALLOY PRODUCT AND METHOD FOR PRODUCING SAME

[75] Inventors: Steven A. Clark, Hales Corners; Balathandan S. Pillai, Glendale, both of Wis.

[73] Assignee: Johnson Brass & Machine Foundry, Inc., Saukville, Wis.

[21] Appl. No.: 09/376,067

[22] Filed: Aug. 17, 1999

[51] Int. Cl.[7] ..... C22F 1/043; B22D 13/00

[52] U.S. Cl. ..... 148/539; 148/552

[58] Field of Search ..... 148/539, 552; 419/68, 49

[56] References Cited

U.S. PATENT DOCUMENTS

| | | | |
|---|---|---|---|
| 3,496,624 | 2/1970 | Kerr et al. | 29/196.2 |
| 4,055,417 | 10/1977 | Komiyama et al. | 75/142 |
| 4,693,747 | 9/1987 | Bretz et al. | 75/249 |
| 4,715,893 | 12/1987 | Skinner et al. | 75/249 |
| 5,303,682 | 4/1994 | Donahue et al. | 123/193.1 |
| 5,498,393 | 3/1996 | Horimura et al. | 419/28 |
| 5,527,403 | 6/1996 | Schirra et al. | 148/675 |
| 5,571,347 | 11/1996 | Bergsma | 148/550 |
| 5,595,615 | 1/1997 | Shibata et al. | 148/440 |
| 5,603,783 | 2/1997 | Ferreira | 148/549 |
| 5,744,734 | 4/1998 | Yang et al. | 75/249 |
| 5,837,070 | 11/1998 | Sainfort et al. | 148/552 |
| 5,846,348 | 12/1998 | Sakoda et al. | 148/439 |
| 5,911,843 | 6/1999 | Bergsma | 148/550 |

OTHER PUBLICATIONS

ASM Handbook, vol. 2 Properties and Selection: Nonferrous Alloys and Special–Purpose Materials, p. 141, 1992.

ALCOA TMD Report No. 5, (available at least by Aug. 3, 1999).

The Aluminum Association, Inc., "Aluminum standards and data", pp. 4–15, (1979).

American Foundrymen's Society, "Copper–Base Alloys Foundry Practice", pp. 68–72, (1965).

Barré, International News Magazine of the Investment Casting Institute, pp. 14–15, (Aug., 1998).

Barré, "Hot Isostatic Processing—A Solution into the 21st Century", (available at least by Aug. 3, 1999).

Copper Development Association, "Copper Casting Alloys", p. 96, (1994).

Janco, "Centrifugal Casting", pp. 1–6, (1988).

Johnson Brass and Machine Foundry, Inc. web site, (www-.johnsoncentrifugal.com) materials, (Aug. 6, 1999).

Kittyhawk Products web site (www.kittyhawkinc.com) materials, (available at least by Aug. 6, 1999).

Kittyhawk Products, Hot Isostatic Processing information, (available at least by Aug. 3, 1999).

PTI, Hot Isostatic Pressing information, (available at least by Aug. 3, 1999).

*Primary Examiner*—George Wyszomierski
*Assistant Examiner*—Janelle Morillo
*Attorney, Agent, or Firm*—Foley & Lardner

[57] ABSTRACT

A method for producing a cast aluminum alloy article having high strength and/or toughness is provided. The method includes providing a molten aluminum alloy, centrifugally casting the molten aluminum alloy to form a cast body; and hot isostatically processing the cast body to form a hipped body. The hipped body may optionally be solution heat treated to form a heat treated body, which may subsequently be precipitation hardened to further enhance the properties of the cast product as desired. The method allows the production of cast aluminum alloy articles having physical and mechanical properties similar to those obtained for articles produced from corresponding aluminum alloy chemistries by wrought techniques.

41 Claims, 4 Drawing Sheets

50X CENTRIFUGAL CAST AND HIPPED JC6061-T6C 100X 6061-T651 WROUGHT PLATE 200X 6061-T651 WROUGHT PLATE

100X UNHIPPED CENTRIFUGAL CAST JC6061-T6C

200X UNHIPPED CENTRIFUGAL CAST JC6061-T6C

50X CENTRIFUGAL CAST AND HIPPED JC6061-T6C

100X CENTRIFUGAL CAST AND HIPPED JC6061-T6C

200X CENTRIFUGAL CAST AND HIPPED JC6061-T6C

METAL ALLOY PRODUCT AND METHOD FOR PRODUCING SAME

BACKGROUND OF THE INVENTION

It is well known to form an alloy body by static casting. Static casting includes pouring a molten alloy in a mold, solidifying. However, a problem with static casting is that the resulting alloy body is subject to impurities and high porosity, both of which may reduce the strength of the alloy body.

It is also known to form an alloy body by a wrought method. Such wrought method includes heating an alloy to a temperature below its melting temperature, and striking the alloy to refine the grain size and reduce porosity. The resulting wrought alloy body has generally less porosity than an alloy body produced by static casting. However, the wrought method is often limited to the use of a small number of "standard" alloys, in addition to generally being more complicated and expensive than casting methods.

It is also known to form an alloy body by centrifugal casting. A centrifugally cast alloy body has generally less impurities and porosity than an alloy body produced by static casting. Aluminum pieces produced by centrifugal casting, however, still commonly have a significant amount of porosity and generally do not possess the overall strength and toughness properties that can be achieved with pieces created using wrought techniques.

To date, most centrifugally casting of aluminum alloys has been carried out using alloys with standard cast aluminum chemistries. Due to differences in alloy composition, pieces formed from alloys with standard cast aluminum chemistries are generally incompatible with wrought alloy bodies because the alloys formed by the wrought method and centrifugal casting generally have different physical and mechanical properties.

SUMMARY OF THE INVENTION

The present invention relates to a method for producing cast alloy articles having high strength and/or toughness. The method includes providing a molten alloy, such as a molten aluminum alloy; centrifugally casting the molten alloy to form a cast body; and hot isostatically processing the cast body to form a hipped body. The hipped body may optionally be solution heat treated to form a heat treated body, which may subsequently be precipitation hardened to further enhance the properties of the cast product as desired. The method allows the production of cast aluminum alloy articles having physical properties similar to those obtained for articles produced from corresponding aluminum alloy chemistries by wrought techniques.

The present method can provide a centrifugally cast alloy body having physical and mechanical properties comparable to the physical and mechanical properties typically achieved with a wrought alloy. The method also can allow the production of a cast alloy body which has generally the same chemical composition as a traditional wrought alloy. In many instances, the present method allows the production of a cast alloy body which, in addition to having generally the same chemical composition as a traditional wrought alloy, has many of the same physical and mechanical properties as pieces produced by traditional wrought techniques. This can permit the centrifugally cast alloy body to be coupled or welded to a piece formed through common wrought methods. Various embodiments of the present method can permit one or more of the various advantages discussed above to be achieved. These and other advantages which may be achieved using the present method will be apparent to those skilled in the art upon review of the specification and the appended claims.

BRIEF DESCRIPTION OF THE DRAWINGS

The invention will become more fully understood from the following detailed description, taken in conjunction with the accompanying figures, in which.

DETAILED DESCRIPTION OF EMBODIMENTS

Figure 1:
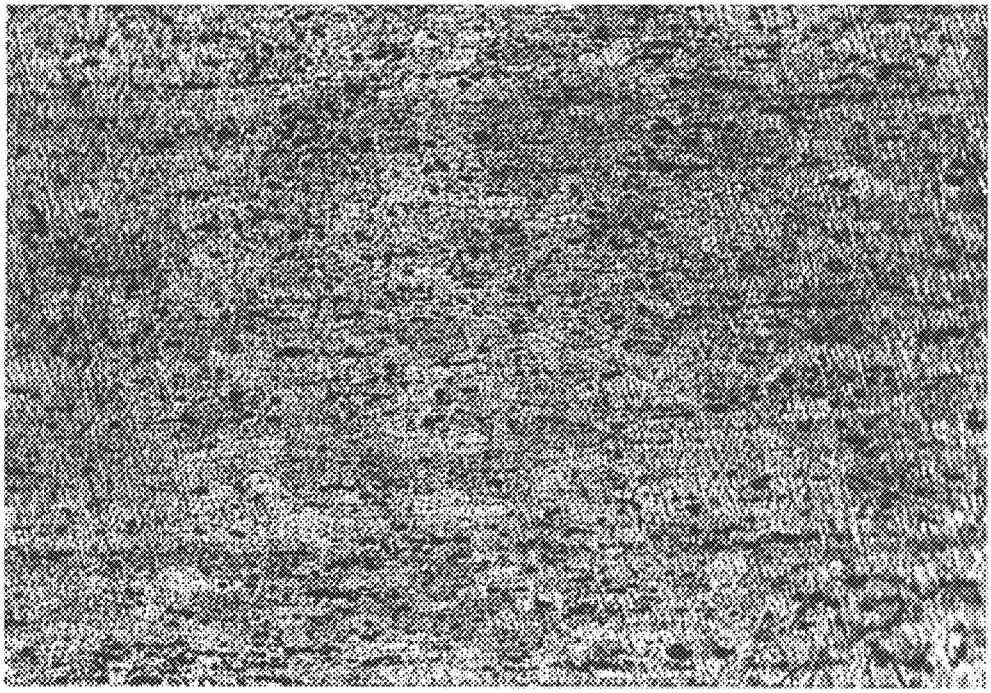
FIG. 1 is a photomicrograph of a traditional wrought 6061-T651 alloy at a magnification of 100X.

The present invention relates to a method for producing cast alloy bodies which includes providing a molten alloy, such as a molten aluminum alloy, centrifugally casting the molten alloy to form a cast body; and hot isostatically processing the cast body to form a hipped body. The hipped body may optionally be solution heat treated to form a heat treated body, which may subsequently be precipitation hardened (also referred to herein as "artificially aged" or "heat aged") to further enhance the properties of the cast product as desired.

Melts may be prepared by heating metal, typically scrap or specially alloyed ingot, in a furnace. If the chemistry of the melt does not meet desired specifications, it may be re-alloyed as necessary with additions the requisite amounts of individual constituent elements. These additions are commonly made to the molten alloy ("melt") in the furnace. The metal which is used to form the melt, whether scrap, alloyed ingot and the like or individual added constituent elements, is collectively referred to herein as "source metal." The chemistry of the alloy (i.e., the amounts of the individual constituent elements) is tightly controlled with respect to the amounts of both major and minor constituents. In some instances, it may be necessary to re-alloy the molten aluminum alloy with additions of minor constituents, such as copper, silicon, magnesium, manganese, zinc or iron, as appropriate. The chemistry of a melt lot may be verified by computerized spectrochemical analysis prior to casting. Melt temperature will vary with the particular alloy composition and is established such that thorough mixing of the constituents is enabled as well as allowing the proper fluidity for the centrifugal cast process. The temperature used should be low enough to minimize gas pickup, oxidation, and degradation of chemistry. For wrought aluminum alloys of the type that are typically employed in the present method, melt temperatures of about 1,000 to 1,500° F. (538 to 816° C.) are common. For example, 6061 aluminum alloys are typically heated to about 1,400° F. (760° C.) to form a melt.

There are various methods of heating metal alloys to form the molten alloy. This can generally be accomplished by heating the source metal. According to a particularly suitable embodiment, the aluminum alloy is melted in an induction furnace, but other melting methods (e.g., gas furnace, convection melting, blast furnace, kiln, or molybdenum furnace) may be employed. Without intending to be limited by theory, it is believed that induction melting produces relatively low levels oxides in the resulting melt as well as facilitating thorough mixing of the melted alloy.

The melted aluminum alloy is generally cast by pouring into a mold capable of being rotated at a relatively high speed (e.g., at least about 500 rpm). According to one common embodiment, the mold is in the shape of a hollow, walled cylinder having an inside diameter about 4–18 inches less than an outside diameter. The interior and the exterior of the mold may be machined to an appropriate configuration. The mold inside diameter is typically machined to the appropriate configuration for the casting outside diameter allowing for any thermal contraction of the cast product which may occur during cooling.

The mold may be made of a variety of materials (e.g., steel, sand, graphite, and the like) having good dimensional stability and good heat transfer properties. The mold is generally made of steel, graphite, or other material capable of providing a high chill rate. From a cost/performance standpoint, mild steel and graphite are materials which are particularly suitable for use as mold materials in conjunction with the present method. To facilitate removal of the cast piece, the mold may be coated with a protective insulating release agent, such as Permcoat or Centrificoat release agents. Molds made of graphite are quite suitable for use in the present method. Graphite molds having an inside diameter of about 10–45 inches are typically used in the present method. In most instances, the graphite mold is encased in a larger mold mild steel mold. Although larger graphite molds may also be employed, it is quite common to centrifugally cast larger pieces using mild steel molds.

The melted alloy is poured into the mold, which may be pre-heated. Commonly, the metal is generally transferred directly from the melt furnace to a pouring ladle. The metal temperature is generally checked just prior to pouring. Metal is poured directly into the prepared centrifugal mold. The surface of the melted alloy may be skimmed to substantially remove any floating impurities such as oxides. According to a suitable embodiment, about 4000 pounds or less of the melt is poured from a single lot of alloy heated and held in an induction furnace over a period of about up to about 8 hours.

The mold is generally rotated about a vertical axis during the pour. The rotational speed of the mold develops a centrifugal force (e.g., G forces from about 30 to 130 G's). This produces an outward radial force applied to the mold as it is rotated. The centrifugal force is transferred to the molten alloy in the rotating mold through viscous effects. Rotation rates of at least about 500 rpm are commonly employed. The rotational rate is preferably sufficient to produce G forces of at least about 60 to 70 G. The centrifugal force produces separation of impurities in the melted alloy based on differences in densities. As the melted alloy solidifies, impurities (e.g., oxides, dross, nonmetallic impurities and the like) that have a density generally less than the density of aluminum are forced toward the inside diameter of the casting. To a lesser extent, impurities that have a density generally greater than the density of aluminum are generally forced to the outside diameter of the casting. Without intending to be limited by theory, it is believed that the centrifugal force reduces the amount of impurities and/or shrinkage defects (porosity) in the resulting centrifugally cast alloy body (relative to a statically cast body). The melted alloy solidifies until substantially no liquid metal remains in the mold. The solidifying casting feeds progressively from the high pressure liquid metal inside the solidifying cylinder until no metal remains as the inside diameter becomes solid.

Unidirectional chilling of the metal may be assisted by applying a coolant, such as water, to the outside of the mold. During solidification of the molten alloy, the temperature of the mold can drop from about 150 to 800° F. over a period of about 10 to 120 minutes. The solidified alloy (i.e., the centrifgally cast body) may be removed from the mold by overhead crane/hoist or by automatically ejection using conventional mechanical equipment.

The centrifugally cast body may be treated to produce a further reduction in shrinkage defects (porosity) by hot isostatic processing ("hipping") to form a hipped alloy body. Hipping is described in U.S. Pat. No. 3,496,624 issued to Kerr et al., which is hereby incorporated by reference. Hipping includes elevating the temperature of the cast body in an autoclave to a temperature sufficient to achieve a solid state plastic condition and below the melting temperature of the alloy. For aluminum alloys, temperatures of at least about 850° F. and more commonly about 900 to 950° F. are employed. For example, with 6000 series aluminum alloys such as 6061 aluminum temperatures of about 925–985° F. and, preferably from about 950–970° F., are typically employed in the hipping step. A high external pressure (e.g., via a pressurized gas such as argon or nitrogen) is applied such that a substantially equal force is exerted on each surface of the cast body ("isostatic pressure"). Pressures of at least about 10,000 psi are typically utilized. Preferably, isostatic pressures of about 10,000–20,000 psi and more preferably at about 14,000 psi are employed. Such temperature and pressure may be simultaneously applied for a period of more than 1 hour, typically for about 2–6 hours. Such temperature and pressure is intended to reduce the microporosity (microshrinkage defects) and densify the body by collapsing intergranular voids.

Elevated temperature develops a solid state plastic condition in a metal body (e.g., an aluminum alloy body). When heated to a temperature sufficient to achieve a solid state plastic condition while being subjected to very high external pressure, very small internal pores (referred to herein as "micropores" or "micro-shrinkage defects") can be forced to migrate out of the part. The behavior is analogous to squeezing a hollow lump of clay with your hand until it becomes a sold lump of clay. The temperature, pressure and time conditions employed to hip a particular alloyed product will depend on the alloy composition and to some extent, the size and geometry of the product. Different yet similar hipping procedures may be used as long as micro-porosity is substantially eliminated from the alloy material. In general, if the hipping process is carried out at a lower temperature (relatively), higher pressure and/or longer hipping times will be required to render the material substantially free of micropores. As employed herein, substantially free of micropores means a material is substantially free of pores having a largest dimension which exceeds 0.0001 inch (0.1 mil).

Figure 2:
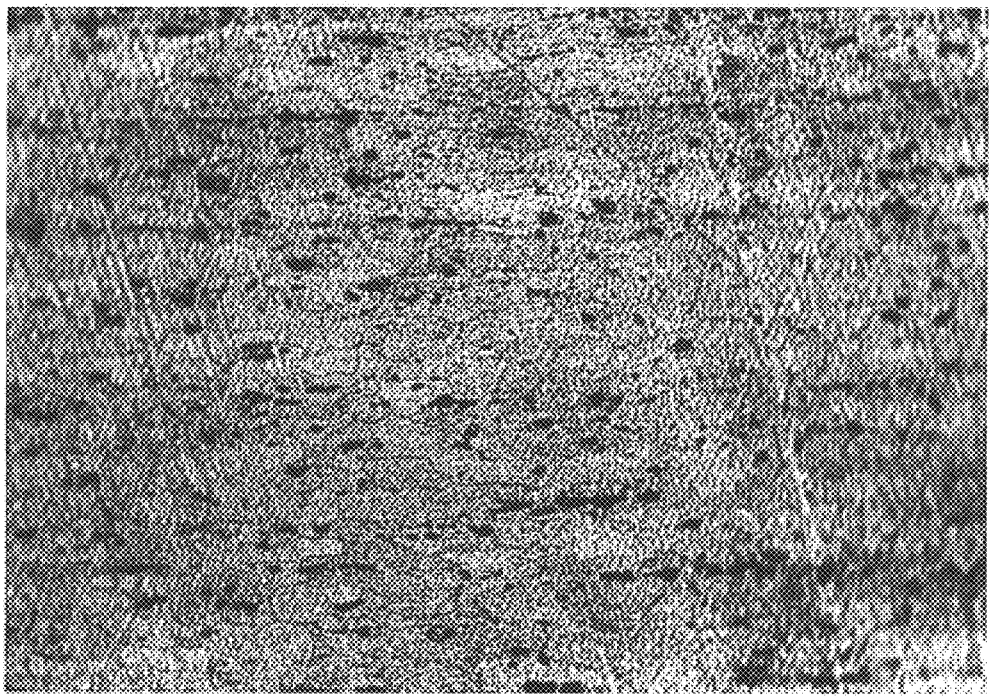
FIG. 2 is a photomicrograph of the alloy of FIG. 1 at a magnification of 200X.

FIGS. 1 and 2 are photomicrographs of a 6061-T651 alloy produced by the traditional wrought method. The expected elongated grain structure associated with wrought products is shown. The grains are generally about 3 times as long as they are wide. Their average size as measured by calipers off of the photograph is about 2300 $\mu$inch by 900 $\mu$inch (0.051 mm by 0.023 mm). The elongated shape of the grain causes variations in directional properties. For example, rings cut from the plate shown in FIGS. 1 and 2 would possess dramatically different mechanical and physical properties in the longitudinal and transverse directions.

Figure 3:
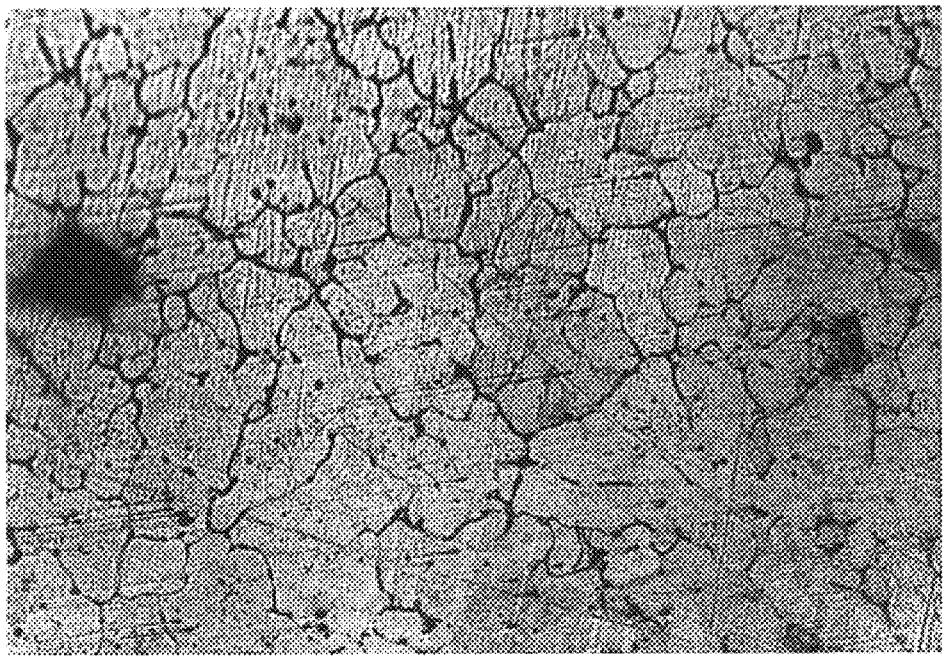
FIG. 3 is a photomicrograph of a traditional centrifugally cast 6061-T6C alloy (i.e., not subjected to hipping) at a magnification of 100X.
Figure 4:
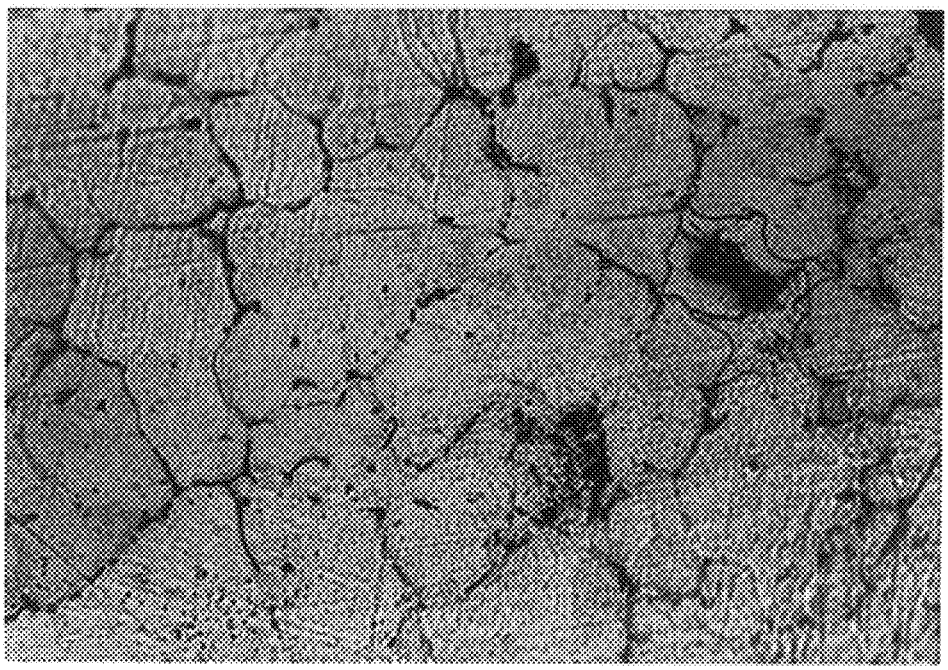
FIG. 4 is a photomicrograph of the alloy of FIG. 3 at a magnification of 200X.

FIGS. 3 and 4 are photomicrographs of a centrifugally cast 6061-T6C alloy which has not been subjected to hipping. The material has a uniform and generally round grain structure is shown. The photomicrographs of FIGS. 3 and 4 also show small discontinuities representative of microporosity (i.e., micro-shrinkage defects). The defects show no specific shape and range in size from less than 1000 $\mu$inch up to 4000 $\mu$inch in size (0.025 mm by 0.102 mm). These defects are believed to be responsible for the traditionally low elongation results from cast aluminum.

Figure 5:
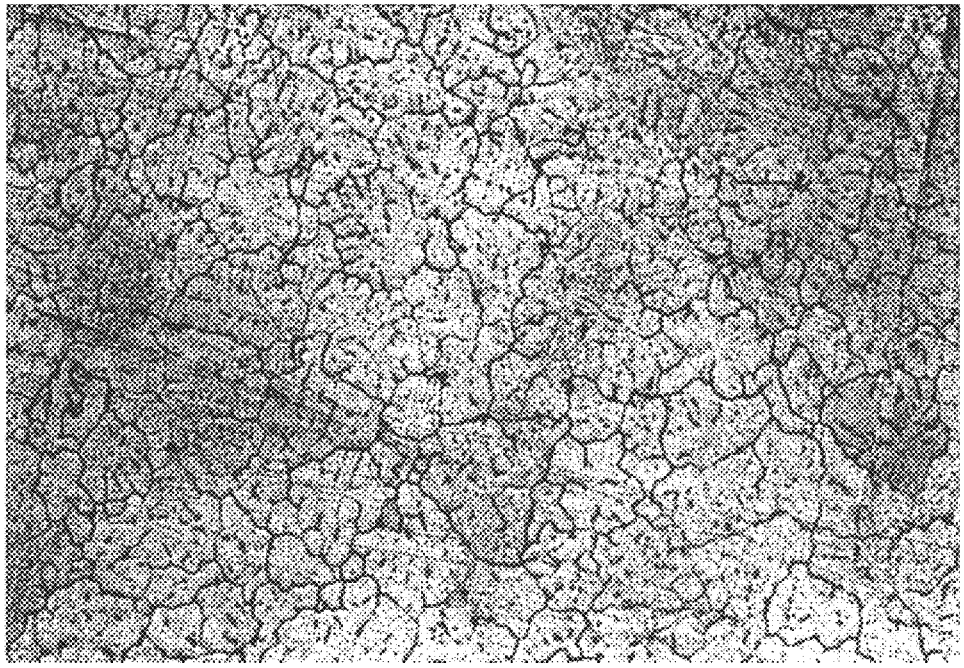
FIG. 5 is a photomicrograph at 50X magnification of a 6061-T6C alloy produced by centrifugal casting and hot isostatic processing.
Figure 6:
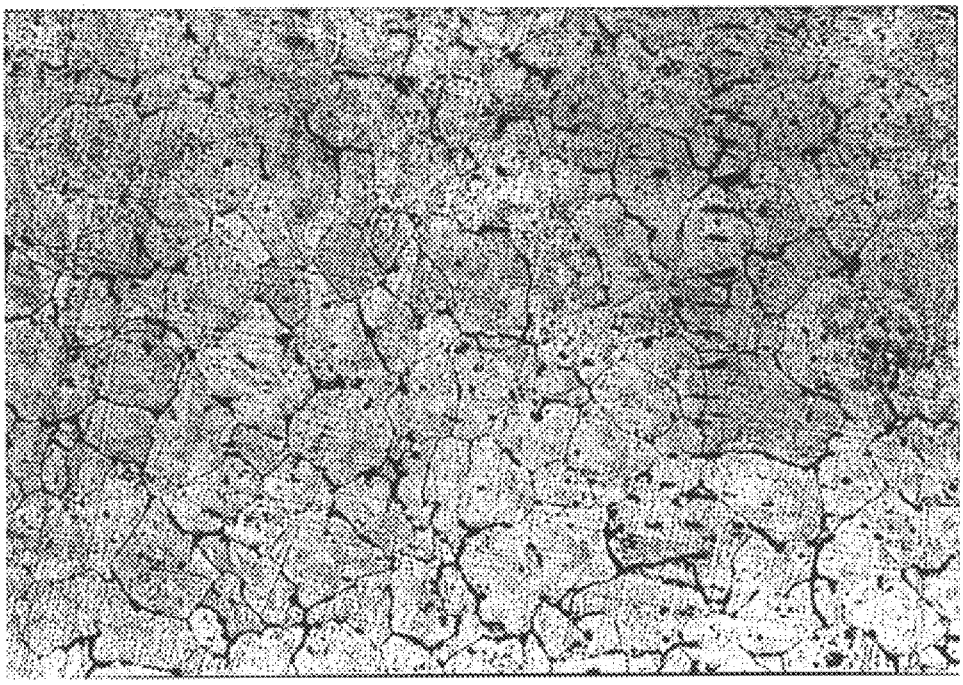
FIG. 6 is a photomicrograph of the alloy of FIG. 5 at a magnification of 100X.
Figure 7:
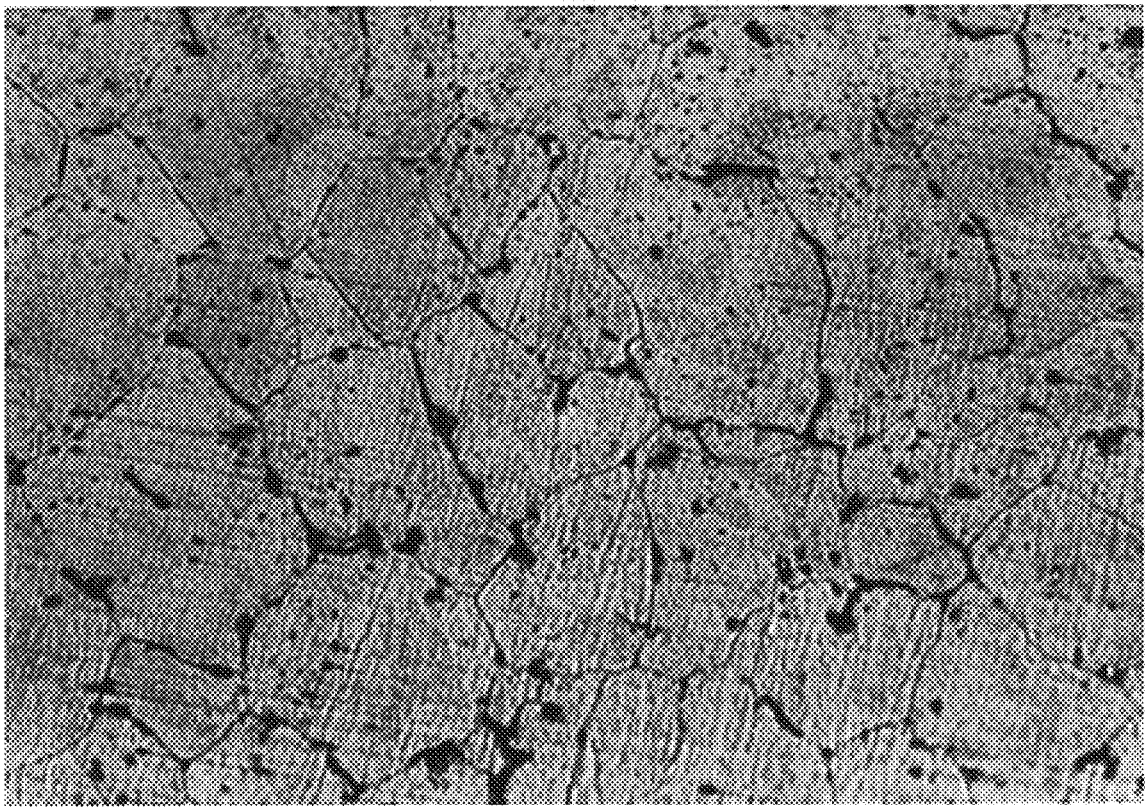
FIG. 7 is a photomicrograph of the alloy of FIG. 5 at a magnification of 200X.

FIGS. 5 and 6 are photomicrographs of a centrifugally cast and hipped 6061-T6C alloy. This material has a uniform and generally round grain structure similar to the sample shown in of FIGS. 3 and 4. In contrast to the cast alloy material shown in FIGS. 3 and 4, the cast and hipped bodies (in FIGS. 5 and 6) show relatively few micro-shrinkage defects (i.e., the resulting body is substantially free of micro-shrinkage defects). The average grain size measures 3400 $\mu$inch (0.086 mm).

Aluminum alloy casting can generally be rendered substantially free of micropores by heating for a period of hours at a temperature of at least about 900° F. (preferably about 925 to 990° F.) while under an isostatic pressure of at least about 10 KSI. For example, micropores can be substantially removed from 6000 series aluminum alloy material (e.g., 6061 type aluminum) by placing the material into a hipping chamber, heating the material to about 960° F. and holding the material at this temperature for about two hours while a pressure of about 14 to 16 KSI is applied.

The hipped body may be solution heat treated to further enhance its physical and/or mechanical properties. This is commonly carried out at a temperature in the range of about 900–1100° F., more preferably in the range of about 960–1000° F. for at least 1 hour, more preferable for about 6–8 hours. The hipped body may then be quenched with water, and then subsequently heated in a furnace at a temperature in the range of about 300–400° F., more preferably in the range of about 325–375° F. for at least 1 hour, more preferably for about 7 to 10 hours. According to an alternative embodiment, the hipped body may undergo T6 heat treatment including solid solution treatment at a temperature in the range of about 900–1,000° F. for about 2–8 hours, followed by water cooling or hot water cooling, and subsequent aging or age hardening at a temperature of about 325–375° C. for about 4–15 hours.

With respect to aging treatments, it should be noted that the hipped body may be subjected to any of the typical under-aging or over-aging treatments well known in the alloy casting arts, including natural aging. In addition, the aging treatment may include multiple aging steps, such as two or three aging steps. Also, stretching or its equivalent working may be used prior to or after part of any multiple aging steps. For two or more aging steps, the first step may include aging at a relatively high temperature followed by a lower temperature or vice versa. For three-step aging, combinations of high and low temperatures may be employed. According to one embodiment, heat aging treatments may be performed in accordance to MIL-H-6088. Aluminum alloy castings produced by the present method, e.g., 6000 series alloys such as 6061, are commonly heat aged after the solution heat treating step (e.g., a "T6" temperature). For example, the heat treated body may be heat aged by heating at 300–400° F., typically for about 2 to 20 hours. Aluminum alloy heat treated bodies are commonly heat aged for 5–10 hours at 325–375° F. Longer times are generally required for heat aging carried out at lower temperatures, e.g., heat aging will typically be carried out for a longer period of time at 300° F. than at 400° F. The heat aging is desirably conducted for a long enough period of time to achieve desired physical properties for the cast product, e.g., to increase the elongation of a heat treated body to at least about 6% and preferably to at least about 8%. For example, desirable cast products can be formed from 6000 series aluminum alloy (e.g., 6061) by the present method by heat aging the solution heat treated body at 325–375° F. for 7–10 hours.

The body may undergo further mechanical or chemical processing. The exterior surface of the hipped body may be machined or "peeled" away. For example, oxides and/or other impurities may be removed from the surfaces by machining the hipped body. As the same time, machining can be used to form smooth and clean surfaces. The cast product may be rough machined to an envelope slightly larger than the finished part. The inner region of unsound oxides and lower porosity is commonly removed by machining. Often the outer skin is also machined away. Parts will usually be rough machined to an envelope yielding the finished part or finish machined. Nondestructive testing (e.g., radiographic examination, fluorescent penetrate inspection, ultrasonic testing, etc.) or destructive testing (e.g., samples cut for photomicrographs) may be performed on the hipped body.

Tensile specimens of standard proportions (e.g., conforming to ASTM B 557) are generally cast with each lot of castings to size in molds representative of the practice used for the castings. Specimens may be taken from actual product castings. Metal for the specimens is part of the melt used for the castings and is subjected to any grain refining additions given the metal for the castings. The temperature of the metal during pouring of the specimens should not be lower than that used during pouring of the castings.

The procedure outlined above may be used to fabricate a variety of resulting products. Such products may include, but are not limited to balls, stators, seals, valve bodies, gears and large flanged bushings. Other products may include turbine and airframe components, medical equipment components, engine run components, high pressure valves and pumps, automotive parts, recreational parts that require premium surface finishes, and the like.

The process outlined above may be performed on a variety of metal alloys but is particularly suitable for use with aluminum alloys. It may also find utility with pieces cast from other metals such as cast iron, steel, stainless steel, and copper-based alloys. It is particularly suitable for use with aluminum alloy chemistries which are traditionally associated with the wrought process. For example, 6000 series wrought aluminum alloys (according to the designation of the Aluminum Association in the United States) may be employed in the present method. 6000 series wrought aluminum alloys include silicon and magnesium in approximate proportions to form magnesium silicide, 6000 series alloys are generally known for being heat treatable. Alloys in the 6000 series may be formed in T4 temper or may be brought to full T6 properties by artificial heat aging. According to a preferred embodiment, the 6000 series alloys include silicon and magnesium in the ratio of about 0.5:1–2:1. Mg-Si type aluminum alloys ("Al-Mg-Si-type alloys"), such as Al-Mg-Si-Cu-Cr type alloys as exemplified by 6000 series alloys, are widely used and favored for their moderately high strength, low quench sensitivity, favorable forming characteristics and corrosion resistance. In one particularly suitable embodiment of the method, the 6000 series aluminum alloy is a 6061 aluminum alloy having the composition as outlined in Table 1 below:

TABLE 1

6061 Aluminum Alloy Composition

| Element | Minimum Wt. % | Maximum Wt. % |
|---|---|---|
| Magnesium | 0.80 | 1.20 |
| Silicon | 0.40 | 0.80 |
| Copper | 0.15 | 0.40 |
| Chromium | 0.04 | 0.35 |
| Iron | — | 0.70 |
| Zinc | — | 0.25 |
| Manganese | — | 0.15 |
| Titanium | — | 0.15 |
| Other Impurities, Each | — | 0.05 |
| Other Impurities, Total | — | 0.15 |
| Aluminum | Remainder | |

Wrought 6061 aluminum alloys are used extensively in aerospace industries in different shapes and sizes. The production of cylindrical parts using wrought techniques is generally expensive due to the process cost and acceptance standards. The present method can provide a cost effective cylindrical dense cast 6061 aluminum alloy by utilizing a combination of centrifugal casting, hot isostatic processing and heat treatment procedures. The present process can be utilized to produce cast 6061-T6 aluminum alloys for lightweight simple or complex cylindrical parts requiring moderate strength and where dimensional stability is required during machining, but usage is not limited to such applications. Corrosion resistance and weldability of this alloy are generally superior to that of aluminum alloys having copper or zinc as the principle alloying element.

Al-Zn-type alloys, such as 7000 series wrought aluminum alloys, are another type of wrought alloy which may be employed in the present method. 7000 series alloys include zinc as the major alloying element. Other elements such as copper and chromium may be included in small quantities. 7020 and 7075 alloys are two examples of such alloys. In particular, 7075 alloys are examples of Al-Zn-Mg-Cu type alloys which are suitable for use in the present method.

Al-Cu type aluminum alloys and, in particular, 2000 series wrought aluminum alloys may also be employed in the present method. 2000 series alloys include Al-Cu alloys in which copper is the principal alloying element, typically in the amount of about 2–4% by weight. Solution heat-treatment of alloys in the 2000 series may result in mechanical properties similar to, and which may exceed, those of mild steel. 2014, 2019, 2219, 2024 (Al-Cu-Mg-Mn type), 2124 (Al-Cu-Mg-Mn type), 2090, 2095 and 2195 are examples of suitable alloys in the 2000 series.

Al-Li type aluminum alloys and, in particular, 8000 series wrought aluminum alloys may also be utilized in the present invention. Lithium is the principal alloying element in the 8000 series. 8090 is an example of a suitable Al-Zn-Mg-Cu-Cr type alloy from the 8000 series.

Traditionally cast aluminum alloys may be used in the present method. Examples of suitable cast type aluminum alloys which can be employed include 356, 319, 771, 443, 713, 336, 535, 206, 355, 850 and 851 cast aluminum alloys.

A cast alloy body may be produced by the method of the present invention with good physical and mechanical properties, such as high strength and/or toughness properties. The tensile strength (i.e., a measure of the breaking stress of a material due to pulling) of an alloy body made by the present method may be in the range of about 22–80 KSI or higher (as determined by ASTM B 557). For example, a 6061-T6 alloy body may be produced by the present method having a tensile strength of at least about 42 KSI (290 MPa), preferably at least about 45 KSI and more preferably at least about 50 KSI. Cast bodies may be formed from 7075-T6 alloy or 2195-T8 alloy by the present method and may have a tensile strength of at least about 75 KSI or 80 KSI, respectively.

The present method may be used to produce cast aluminum bodies which exhibit good elongation and have a yield strength (i.e., the stress at which a marked and permanent increase in the deformation of a material occurs without an increase in the load; determined by ASTM B 557) in the range of about 30 to 50 KSI or higher). For example, a 6061-T6 alloy body can be produced by the present method having yield strength (2% offset) of at least about 40 KSI (275 MPa). The present method may also be used to form cast aluminum bodies from 7075-T6 alloy and 2195-T6 alloy having good elongation and tensile strength properties and 2% offset yield strengths of at least about 65 KSI and 70 KSI, respectively.

The present method can be used to produce cast aluminum alloy bodies with good tensile and yield strength and having an elongation (in 2 inches) of at least about 4%. Elongation relates to the amount a plate of the alloy bends before breaking. For example, the present method can be used to produce a 6061-T6 alloy body having an elongation of at least about 6% and, preferably, at least about 8% while still exhibiting good tensile and yield strength properties. For example, the present method permits the production of cast aluminum pieces having an elongation of 6%, a tensile strength of at least about 45 KSI and a yield strength (2% offset) of at least about 40 KSI. The present method may be used to form cast pieces from other aluminum alloys, such as 7075-T6 alloy and 2195-T6 alloy which have elongation of about 8% or higher while retaining good tensile and yield strength properties.

The Brinell hardness (i.e., the area of indentation produced by a hardened steel ball of 10 mm in diameter under a pressure of 500 kilograms; BHN 10/500) of an alloy body made by the present method is typically at least about 80. The hardness is typically at least about 85 when a 10 mm ball under a pressure of 1000 kilograms (BHN 10/1000) is used to test Brinell hardness. For example, the present method permits the production of cast 6061-T6 aluminum alloy pieces having a Brinell hardness at 500 kg (BHN 10/500) in the range of about 100–120 and also having tensile properties similar to those obtainable in 6061 pieces created by wrought techniques.

Examples of physical properties which can be achieved with castings produced by the present method for some exemplary wrought aluminum alloy chemistries are shown in Table 2 below:

TABLE 2

Physical Properties of Cast Aluminum Alloys

| Alloy | Tensile strength (KSI) | Yield strength (KSI) | Elongation % (2 inches) |
|---|---|---|---|
| 7075-T6 | 75 | 65 | 8 |
| 6061-T6 | 48 | 42 | 8 |

The final cast products produced by the present method should have smooth and clean surfaces suitable for fluorescent penetrant inspection and can be subjected to fluorescent penetrant inspection of all exposed surfaces, e.g., in accordance to ASTM E 1417. Standards for acceptance are generally established by the cognizant engineering organization. Surface imperfections which can be removed so that the imperfections do not reappear on etching and do not violate the finished part envelope may be acceptable. When desired, the cast products can be subjected to ultrasonic inspection, such as in accordance with ASTM B 594. Cast pieces produced by the present method commonly meet ultrasonic Class A. The final cast products can also be subjected to radiographic examination in accordance with AMS 2635, or other acceptable technique. ASTM # 155 may be used to define radiographic acceptance standards.

The alloys and methods of the present invention may be illustrated by the following examples, which are intended to illustrate the present invention and to teach one of ordinary skill how to make and use the invention. These examples are not intended in any way to limit or narrow the scope of protection afforded by the claims.

EXAMPLE 1

250 Lbs. of 6061 scrap aluminum alloy was melted in a gas fired furnace where mixing of the molten metal is done manually and the temperature was brought to 1400° F. Alloy chemistry was checked in the Lab, using spectrochemical method and additions of various elements were made as required. The chemical composition of the alloy was as follows:

| | | | | |
|---|---|---|---|---|
| Cu | Sn | Pb | Zn | Fe |
| 0.21 | 0.003 | 0.04 | 0.02 | 0.15 |
| Ni | Si | Mn | Mg | Ti |
| 0.01 | 0.56 | 0.04 | 0.84 | 0.01 |
| Cr | Al | | | |
| 0.08 | 98.02 | | | |

Three castings with 60 lbs. each were poured with the lot of molten aluminum into a graphite mold spinning at 700 rpm. The castings made were hipped at 960±25° F. under an isostatic pressure of 14.750±250 psi for 2 hours. The hiiped casting was then solution heat treated at 930° F. for 6 hours and water quenched. The quenched body was then aged (precipitation hardened) at 350° F. for 8.5 hours and finally machined for physical properties. The physical properties are as below:

| S/N | Brinell Hardness (at 500 kg load (BHN) | Yield Strength | Tensile Strength | Elongation % |
|---|---|---|---|---|
| 1a | 71.5 | 24.3 | 36.1 | 9.0 |
| 1b | 74.1 | 24.7 | 29.3 | 4.5 |
| 1c | 79.6 | 23.6 | 27.9 | 4.25 |

EXAMPLE 2

150 Lbs. of 6061 scrap aluminum alloy was melted in a gas fired furnace and its temperature brought to 1400° F. with manual mixing. A casting was produced using the procedure described in Example I above. Various constituent elements were added to the melt to give the chemical composition shown below. The chemical composition and physical properties are as below:

| | | | | |
|---|---|---|---|---|
| Cu | Sn | Pb | Zn | Fe |
| .035 | <0.001 | 0.01 | <0.00 | 0.27 |
| Ni | Si | Mn | Mg | Ti |
| 0.02 | 0.74 | 0.03 | 1.49 | 0.002 |
| Cr | Al | | | |
| 0.07 | 97.01 | | | |

| Physical Properties | | | |
|---|---|---|---|
| BHN At 500 kg load | Yield Strength | Tensile Strength | Elongation % |
| 92.6 | 33.27 | 39.11 | 4.0 |

EXAMPLE 3

150 lbs of 6061 scrap aluminum alloy was melted in a gas fired furnace and its temperature brought to 1400° F. One 60 Lb. casting and a test bar were produced using the procedure described in Example I above. Various constituent elements were added to the melt to give the chemical composition shown below. The chemical composition and physical properties are as below:

| Chemistry | | | | |
|---|---|---|---|---|
| Cu | Sn | Pb | Zn | Fe |
| 1.9 | <0.0001 | 0.003 | <0.00 | 0.25 |
| Ni | Si | Mn | Mg | Ti |
| 0.009 | 2.36 | 0.036 | 2.19 | 0.1005 |
| Cr | Al | | | |
| 0.219 | 92.86 | | | |

| Physical Properties | | | |
|---|---|---|---|
| BHN At 500 kg load | Yield Strength | Tensile Strength | Elongation % |
| 124 | 43.1 | 48.7 | 1.0 |

EXAMPLE 4

150 Lbs. of 6061 scrap aluminum alloy was melted in a gas fired furnace and its temperature brought to 1400° F. One 60 Lb. casting and a test bar were produced using the procedure described in Example I above. Various constituent elements were added to the melt to give the chemical composition shown below. The chemical composition and physical properties are as below:

| Chemical Composition | | | | |
|---|---|---|---|---|
| Cu | Sn | Pb | Zn | Fe |
| 2.7 | <0.0001 | 0.003 | <0.0001 | 0.25 |
| Ni | Si | Mn | Mg | Ti |
| 0.007 | 0.65 | 0.03 | 1.18 | 0.14 |
| Cr | Al | | | |
| 0.35 | 94.68 | | | |

| Physical Properties | | | |
|---|---|---|---|
| BHN At 500 kg load | Yield Strength | Tensile Strength | Elongation % |
| 119 | 59.6 | 43.8 | 6.5 |

EXAMPLE 5

1200 Lbs. of 6061 scrap aluminum alloy was melted in an induction furnace to have better stirring of the molten metal. Twenty 60 Lb. castings and four test bars (sample numbers denoted "TB" in Tables 3 and 4) were produced using the procedure described in Example I above. Various constituent elements were added to the melt to give the chemical composition shown below. The chemical composition and physical properties of the castings are shown in Tables 3 and 4 below.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention.

TABLE 3

| Sample No. | Cu | Sn | Pb | Zn | Fe | Ni | Si | Mn | Mg | Ti | Cr | Base |
|---|---|---|---|---|---|---|---|---|---|---|---|---|
| 1a/TB | 0.3248 | <0.0001 | 0.0004 | <0.0001 | 0.2191 | 0.0043 | 0.6775 | 0.0236 | 0.9049 | 0.2065 | 0.0164 | 97.562 |
| 1b/TB | 0.3108 | <0.0001 | 0.0030 | <0.0001 | 0.2278 | 0.0037 | 0.6542 | 0.0235 | 0.9087 | 0.0605 | 0.2291 | 97.579 |
| 1c/TB | 0.3108 | <0.0001 | 0.0030 | <0.0001 | 0.2278 | 0.0037 | 0.6542 | 0.0235 | 0.9087 | 0.0605 | 0.2291 | 97.579 |
| 1a | 0.2911 | <0.0001 | 0.0018 | <0.0001 | 0.2611 | 0.0049 | 0.7018 | 0.0252 | 1.018 | 0.0382 | 0.2309 | 97.428 |
| 1b | 0.3078 | <0.0001 | <0.0001 | <0.0001 | 0.2478 | 0.0051 | 0.5918 | 0.0249 | 1.013 | 0.0147 | 0.2151 | 97.479 |
| 2a | 0.3963 | <0.0001 | 0.0032 | <0.0001 | 0.2580 | 0.0068 | 0.6721 | 0.0221 | 0.9148 | 0.0754 | 0.2593 | 97.388 |
| 2b | 0.2980 | <0.0001 | 0.0014 | <0.0001 | 0.2120 | 0.0036 | 0.6078 | 0.0230 | 0.8704 | 0.0708 | 0.2595 | 97.654 |
| 3a | 0.4107 | <0.0001 | 0.0094 | <2.0001 | 0.2346 | 0.0061 | 0.6550 | 0.0240 | 0.9605 | 0.0494 | 0.2374 | 97.413 |
| 3b | 0.3327 | <0.0001 | 0.0016 | <0.0001 | 0.2207 | 0.0046 | 0.6528 | 0.0233 | 0.9558 | 0.0361 | 0.2195 | 97.553 |
| 4a | 0.3293 | <0.0001 | 0.0064 | <0.0001 | 0.2461 | 0.0038 | 0.6534 | 0.0222 | 0.8672 | 0.0273 | 0.2130 | 97.631 |
| 4b | 0.3268 | <0.0001 | 0.0017 | <0.0001 | 0.2292 | 0.0041 | 0.6503 | 0.0236 | 0.9550 | 0.0529 | 0.2333 | 97.523 |
| 5a | 0.3336 | <0.0001 | 0.0017 | <0.0001 | 0.2313 | 0.0047 | 0.6609 | 0.0242 | 0.9692 | 0.0215 | 0.1994 | 97.553 |
| 5b | 0.3449 | <0.0001 | 0.0001 | <0.0001 | 0.2330 | 0.0048 | 0.6535 | 0.0244 | 0.9932 | 0.0215 | 0.2079 | 97.517 |
| 2a/TB | 0.2817 | <0.0001 | 0.0015 | <0.0001 | 0.2018 | 0.0034 | 0.5671 | 0.0231 | 1.004 | 0.1797 | 0.3178 | 97.42 |
| 2b/TB | 0.3127 | <0.0001 | 0.0012 | <0.0001 | 0.2276 | 0.0034 | 0.6040 | 0.0238 | 1.043 | 0.1605 | 0.3169 | 97.307 |
| 6a | 0.4227 | <0.0001 | 0.0041 | <0.0001 | 0.2327 | 0.0057 | 0.6756 | 0.0238 | 1.118 | 0.0730 | 0.2970 | 97.147 |
| 6b | 0.3893 | <0.0001 | 0.0021 | <0.0001 | 0.2369 | 0.0052 | 0.6805 | 0.0238 | 1.121 | 0.0646 | 0.2964 | 97.180 |
| 7a | 0.3085 | <0.0001 | <0.0001 | <0.0001 | 0.2291 | 0.0038 | 0.6165 | 0.0237 | 1.038 | 0.1387 | 0.3099 | 97.332 |
| 7b | 0.3458 | <0.0001 | 0.0032 | <0.0001 | 0.2376 | 0.0048 | 0.6127 | 0.0245 | 1.023 | 0.1385 | 0.3191 | 97.290 |
| 8a | 0.3316 | <0.0001 | 0.0011 | <0.0001 | 0.2231 | 0.0042 | 0.6249 | 0.0237 | 1.040 | 0.0749 | 0.3031 | 97.393 |
| 8b | 0.3321 | <0.0001 | 0.0018 | <0.0001 | 0.2081 | 0.0042 | 0.6151 | 0.0233 | 1.024 | 0.0913 | 0.3056 | 97.394 |
| 9a | 0.3267 | <0.0001 | 0.0001 | <0.0001 | 0.2149 | 0.0046 | 0.6050 | 0.0224 | 0.9811 | 0.0964 | 0.3158 | 97.433 |
| 9b | 0.3410 | <0.0001 | 0.0016 | <0.0001 | 0.2280 | 0.0049 | 0.6247 | 0.0231 | 1.002 | 0.1269 | 0.3152 | 97.333 |
| 10a | 0.3360 | <0.0001 | 0.0015 | <0.0001 | 0.2148 | 0.0039 | 0.6162 | 0.0232 | 1.008 | 0.0795 | 0.3071 | 97.410 |
| 10b | 0.3380 | <0.0001 | 0.0007 | <0.0001 | 0.1978 | 0.0044 | 0.6126 | 0.0224 | 0.9916 | 0.0648 | 0.3110 | 97.451 |
| 3a/TB | 0.3527 | <0.0001 | 0.0016 | <0.0001 | 0.2343 | 0.0041 | 0.6478 | 0.0205 | 0.9912 | 0.1530 | 0.2995 | 97.296 |
| 3b/TB | 0.3720 | <0.0001 | 0.0013 | <0.0001 | 0.2356 | 0.0055 | 0.6439 | 0.0213 | 0.9924 | 0.1587 | 0.3071 | 97.262 |
| 11a | 0.3044 | <0.0001 | 0.0055 | <0.0001 | 0.2151 | 0.0040 | 0.6002 | 0.0193 | 0.9204 | 0.1851 | 0.2988 | 97.447 |
| 11b | 0.3119 | <0.0001 | 0.0026 | 0.2231 | 0.0041 | 0.5946 | 0.0193 | 0.8978 | 0.1878 | 0.1882 | 0.3023 | 97.456 |
| 12a | 0.4455 | <0.0001 | 0.0095 | <0.0001 | 0.2560 | 0.0059 | 0.6747 | 0.0204 | 1.001 | 0.2024 | 0.3069 | 97.078 |
| 12b | 0.3594 | <0.0001 | 0.0008 | <0.0001 | 0.2278 | 0.0039 | 0.6681 | 0.0207 | 1.042 | 0.1316 | 0.2912 | 97.254 |
| 13a | 0.2709 | <0.0001 | 0.0028 | <0.0001 | 0.2353 | 0.0028 | 0.5919 | 0.0177 | 0.8611 | 0.2164 | 0.2967 | 97.534 |
| 13b | 0.3033 | <0.0001 | 0.0011 | <0.0001 | 0.2145 | 0.0037 | 0.5952 | 0.0191 | 0.8916 | 0.2309 | 0.3062 | 97.445 |
| 14a | 0.2957 | <0.0001 | 0.0019 | <0.0001 | 0.2190 | 0.0040 | 0.5999 | 0.0191 | 0.8948 | 0.2073 | 0.2985 | 97.460 |
| 14b | 0.2931 | <0.0001 | 0.0010 | <0.0001 | 0.2173 | 0.0041 | 0.5794 | 0.0192 | 0.8807 | 0.2094 | 0.3009 | 97.497 |
| 15a | 0.3020 | <0.0001 | 0.0025 | <0.0001 | 0.2027 | 0.0037 | 0.6202 | 0.0183 | 0.9182 | 0.1737 | 0.2845 | 97.474 |
| 15b | 0.3298 | <0.0001 | 0.0074 | <0.0001 | 0.2059 | 0.0047 | 0.6047 | 0.0188 | 0.8934 | 0.1939 | 0.2980 | 97.451 |
| 4a/TB | 0.1984 | <0.0001 | 0.0029 | <0.0001 | 0.2218 | 0.0034 | 0.6382 | 0.0198 | 0.9188 | 0.1240 | 0.1984 | 97.674 |
| 4b/TB | 0.2077 | <0.0001 | 0.0021 | <0.0001 | 0.2307 | 0.0040 | 0.6303 | 0.0199 | 0.9049 | 0.1290 | 0.2009 | 97.670 |
| 4c/TB | 0.2752 | <0.0001 | 0.0048 | <0.0001 | 0.2334 | 0.0053 | 0.6267 | 0.0198 | 0.8916 | 0.1515 | 0.2039 | 97.588 |
| 16a | 0.2278 | <0.0001 | 0.0053 | <0.0001 | 0.2288 | 0.0054 | 0.6136 | 0.0195 | 0.8602 | 0.1533 | 0.2042 | 97.682 |
| 16b | 0.2278 | <0.0001 | 0.0053 | <0.0001 | 0.2288 | 0.0054 | 0.6136 | 0.0195 | 0.8602 | 0.1533 | 0.2042 | 97.682 |
| 17a | 0.2601 | <0.0001 | 0.0041 | <0.0001 | 0.2243 | 0.0064 | 0.6327 | 0.0186 | 0.8987 | 0.1451 | 0.1974 | 97.613 |
| 17b | 0.2010 | <0.0001 | 0.0026 | <0.0001 | 0.2367 | 0.0034 | 0.6325 | 0.0194 | 0.9179 | 0.1236 | 0.1944 | 97.668 |
| 18a | 0.2102 | <0.0001 | 0.0094 | <0.0001 | 0.2261 | 0.0049 | 0.5937 | 0.0196 | 0.8362 | 0.1706 | 0.2072 | 97.722 |
| 18b | 0.2226 | <0.0001 | 0.0057 | <0.0001 | 0.2281 | 0.0059 | 0.5802 | 0.0199 | 0.8342 | 0.1747 | 0.2091 | 97.720 |
| 19a | 0.2176 | <0.0001 | 0.0021 | <0.0001 | 0.2420 | 0.0036 | 0.6676 | 0.0193 | 0.9396 | 0.1064 | 0.1896 | 97.612 |
| 19b | 0.1752 | <0.0001 | 0.0021 | <0.0001 | 0.2259 | 0.0043 | 0.5901 | 0.0188 | 0.8983 | 0.1586 | 0.1991 | 97.778 |
| 20a | 0.3805 | <0.0001 | 0.0185 | <0.0001 | 0.2262 | 0.0082 | 0.6254 | 0.0183 | 0.8524 | 0.1600 | 0.2024 | 97.508 |
| 20b | 0.1803 | <0.0001 | 0.0018 | <0.0001 | 0.2270 | 0.10042 | 0.5950 | 0.0188 | 0.8303 | 0.1515 | 0.2000 | 97.791 |

TABLE 4

| Sample No. | Yield Strength | Tensile Strength | % Elongation | Comments | Hardness BHN at 500 g |
|---|---|---|---|---|---|
| 1a/TB | 45.69 | 49.17 | 3.0 | | 109 |
| 1b/TB | 45.58 | 49.13 | 3.0 | | 109 |
| 1c/TB | 49.40 | 50.0 | 4.0 | | 109 |
| 1a | 42.51 | 45.59 | 2.5 | Not hipped | 109 |
| 1b | 42.51 | 45.56 | 2.5 | Not hipped | 109 |
| 2a | 45.73 | 50.89 | 6.0 | | 109 |
| 2b | 45.64 | 50.45 | 6.0 | | 109 |
| 3a | 44.42 | 48.95 | 4.0 | | 109 |
| 3b | 44.23 | 48.83 | 4.0 | | 109 |
| 4a | 44.37 | 48.80 | 4.0 | | 109 |
| 4b | 44.27 | 48.86 | 4.0 | | 109 |
| 5a | 44.39 | 48.96 | 3.5 | | 109 |
| 5b | 44.30 | 48.81 | 3.5 | | 109 |
| 2a/TB | 42.91 | 49.49 | 6.5 | | 109 |
| 2b/TB | 43.02 | 49.07 | 6.5 | | 109 |
| 6a | 40.81 | 43.40 | 2.5 | Not Hipped | 109 |
| 6b | 40.73 | 42.37 | 1.5 | Not Hipped | 109 |
| 7a | 42.74 | 48.65 | 5.0 | | 109 |
| 7b | 42.79 | 48.63 | 5.5 | | 109 |
| 8a | 42.32 | 48.42 | 6.0 | | 109 |
| 8b | 42.14 | 48.34 | 5.5 | | 109 |
| 9a | 43.17 | 47.73 | 3.5 | | 109 |
| 9b | 43.23 | 47.79 | 4.0 | | 109 |
| 10a | 43.25 | 48.19 | 4.5 | | 109 |
| 10b | 43.36 | 48.36 | 4.5 | | 109 |
| 3a/TB | 44.98 | 50.47 | 5.0 | | 109 |
| 3b/TB | 45.02 | 50.41 | 5.5 | | 109 |
| 11a | 42.33 | 45.59 | 2.0 | Not Hipped | 109 |
| 11b | 42.19 | 45.48 | 2.0 | Not Hipped | 109 |
| 12a | 44.24 | 49.30 | 4.5 | | 109 |
| 12b | 44.43 | 49.28 | 4.0 | | 109 |
| 13a | 44.39 | 49.19 | 4.0 | | 109 |
| 13b | 44.52 | 49.19 | 4.0 | | 109 |
| 14a | 45.22 | 49.50 | 4.0 | | 109 |
| 14b | 45.23 | 49.59 | 4.0 | | 109 |
| 15a | 44.89 | 49.15 | 3.5 | | 109 |
| 15b | 44.95 | 49.12 | 3.5 | | 109 |
| 4a/TB | 44.54 | 45.98 | 1.5 | | 109 |
| 4b/TB | 44.74 | 49.92 | 6.0 | | 109 |
| 4c/TB | 41.40 | 51.50 | 8.0 | | 109 |
| 16a | 42.67 | 45.41 | 2.0 | Not Hipped | 109 |
| 16b | 42.54 | 45.26 | 2.0 | Not Hipped | 109 |
| 17a | 44.77 | 48.44 | 3.5 | | 109 |
| 17b | 44.57 | 48.55 | 3.5 | | 109 |
| 18a | 44.95 | 48.18 | 3.5 | | 109 |
| 18b | 44.87 | 48.25 | 3.0 | | 109 |
| 19a | 44.77 | 48.33 | 3.0 | | 109 |
| 19b | 44.75 | 48.14 | 3.0 | | 109 |
| 20a | 44.44 | 47.71 | 3.0 | | 109 |
| 20b | 44.68 | 47.89 | 2.5 | | 109 |

What is claimed is:

1. A method for producing a high strength cast aluminum alloy body comprising:

providing a molten aluminum alloy selected from the group consisting of 2000, 4000, 6000, 7000 and 8000 series aluminum alloys;

centrifugally casting the molten aluminum alloy in a mold to form a cast body; and hot isostatically processing the cast body to form a hipped body.

2. The method of claim 1, further comprising solution heat treating the hipped body to form a heat treated body.

3. The method of claim 2, wherein the solution heat treating step comprises heating the hipped body to at least about 850° F.

4. The method of claim 3, wherein the solution heat treating step comprises heating the hipped body for at least about 2 hours.

5. The method of claim 4, wherein the aluminum alloy is a 6061 aluminum alloy and the solution heat treating step comprises heating the hipped body to about 900 to 950° F. for about 4 to 10 hours.

6. The method of claim 2, further comprising heat aging the heat treated body to form an aged body.

7. The method of claim 6, wherein the heat aging step comprises heating the heat treated body at about 300 to 400° F.

8. The method of claim 6, wherein the heat aging step comprises heating the heat treated body for about 2 to 20 hours.

9. The method of claim 7, wherein the aluminum alloy is a 6061 aluminum alloy and the heat aging step comprises heating the heat treated body at about 325 to 375° F. for about 7 to 10 hours.

10. The method of claim 6, further comprising machining the aged body to remove an impurity region.

11. The method of claim 1, wherein the centrifugally casting step comprises rotating a mold at a speed of at least about 500 rpm.

12. The method of claim 1, wherein the centrifugally casting step comprises centrifugally casting the molten aluminum alloy at a centrifugal acceleration of at least about 30 G.

13. The method of claim 2, further comprising machining the heat treated body to remove an impurity region.

14. The method of claim 1, wherein the hot isostatically processing step comprises heating the cast body at a temperature of at least about 900° F. while applying an isostatic pressure of at least about 10 KSI.

15. The method of claim 14, wherein the hot isostatically processing step comprises heating the cast body to a temperature of about 935 to 985° F. for at least one hour while applying an isostatic pressure of at least about 14 KSI.

16. The method of claim 1, wherein the step of providing a molten aluminum alloy comprises forming melted aluminum alloy in an induction furnace.

17. The method of claim 1, wherein the molten aluminum alloy is selected from the group consisting of 2000, 6000 and 7000 aluminum alloys.

18. The method of claim 1, wherein providing the molten aluminum alloy comprises forming the molten aluminum alloy in an induction furnace; and further comprising solution heat treating the hipped body to form a heat treated body, and heat aging the heat treated body to form an aged body.

19. The method of claim 18, wherein the hipped body is solution heat treated to at least about 850° F. to form the heat treated body, and the heat treated body is heat aged at about 300 to 400° F. to form an aged body.

20. A method for producing a high strength cast aluminum alloy body comprising:

providing a molten aluminum alloy selected from the group consisting of 6000 series aluminum alloys;

centrifugally casting the molten aluminum alloy in a mold to form a cast body; and hot isostatically processing the cast body to form a hipped body.

21. The method of claim 20, wherein the molten aluminum alloy is a 6061 aluminum alloy.

22. The method of claim 20, wherein the molten aluminum alloy includes about 0.4–0.8% Si, 0.15–0.4% Cu, 0.04–0.35% Cr, 0.8–1.2% Mg, 0.05–0.7% Fe and at least 94.85 wt % Al.

23. The method of claim 20, wherein the molten aluminum alloy includes silicon and magnesium in the ratio of about 0.5:1 to 2:1.

24. The method of claim 20, further comprising heat treating the hipped body to produce an aluminum alloy body having a T4 temper.

25. The method of claim 20, further comprising heat treating the hipped body to produce an aluminum alloy body having a T6 temper.

26. The method of claim 20, wherein the molten aluminum alloy is a Al-Mg-Si-Cu-Cr type aluminum alloy.

27. The method of claim 20, wherein providing the molten aluminum alloy comprises forming the molten aluminum alloy in an induction furnace; and further comprising solution heat treating the hipped body to at least about 850° F. to form a heat treated body, and heat aging the heat treated body at about 300 to 400° F. to form an aged body.

28. The method of claim 27, wherein the molten aluminum alloy is selected from the group consisting of 2014, 2019, 2219, 2090, 2095, 2195, 2024 and 2124 aluminum alloys.

29. The method of claim 27, wherein the molten aluminum alloy is a 6061 aluminum alloy.

30. A method for producing a high strength cast aluminum alloy body comprising:

providing a molten aluminum alloy selected from the group consisting of 7000 series aluminum alloys;

centrifugally casting the molten aluminum alloy in a mold to form a cast body; and hot isostatically processing the cast body to form a hipped body.

31. The method of claim 30, wherein the molten aluminum alloy is a 7020 aluminum alloy.

32. The method of claim 30, wherein the molten aluminum alloy includes chromium, copper or a mixture thereof.

33. The method of claim 30, wherein providing the molten aluminum alloy comprises forming the molten aluminum alloy in an induction furnace; and further comprises solution heat treating the hipped body to form a heat treated body, and heat aging the heat treated body to form an aged body.

34. The method of claim 30, wherein the molten aluminum alloy is a Al-Zn-Mg-Cu type alloy.

35. The method of claim 34, wherein the molten aluminum alloy is a 7075 aluminum alloy.

36. A method for producing a high strength cast aluminum alloy body comprising:

providing a molten aluminum alloy selected from the group consisting of 2000 series aluminum alloys;

centrifugally casting the molten aluminum alloy in a mold to form a cast body; and hot isostatically processing the cast body to form a hipped body.

37. The method of claim 36, wherein the molten aluminum alloy includes 2–4 weight % copper.

38. The method of claim 36, wherein providing the molten aluminum alloy comprises forming the molten aluminum alloy in an induction furnace; and further comprising solution heat treating the hipped body to form a heat treated body, and heat aging the heat treated body to form an aged body.

39. The method of claim 36, wherein the molten aluminum alloy is a Al-Cu-Mg-Mn type aluminum alloy.

40. The method of claim 39, wherein the molten aluminum alloy is a 2024 or 2124 aluminum alloy.

41. The method of claim 36, wherein the molten aluminum alloy is a 2219 aluminum alloy.

* * * * *